US005845625A

United States Patent [19]

Kidokoro et al.

[11] Patent Number: 5,845,625

[45] Date of Patent: Dec. 8, 1998

[54] DEFECT DIAGNOSING APPARATUS OF EVAPORATION PURGE SYSTEM

[75] Inventors: Toru Kidokoro, Hadano; Takaaki Ito, Mishima; Naoya Takagi, Susono, all of Japan

[73] Assignee: Toyota Jidosha Kabushiki Kaisha, Toyota, Japan

[21] Appl. No.: 895,181

[22] Filed: Jul. 16, 1997

[30] Foreign Application Priority Data

Jul. 19, 1996 [JP] Japan ..... 8-190895

[51] Int. Cl.[6] ..... F02M 33/02

[52] U.S. Cl. ..... 123/520

[58] Field of Search ..... 123/516, 518, 123/519, 520

[56] References Cited

U.S. PATENT DOCUMENTS

| | | | |
|---|---|---|---|
| 5,220,898 | 6/1993 | Kidokoro et al. | 123/519 |
| 5,259,353 | 11/1993 | Nakai et al. | 123/520 |
| 5,437,256 | 8/1995 | Woletz et al. | 123/519 |
| 5,443,051 | 8/1995 | Otsuka | 123/520 |
| 5,590,634 | 1/1997 | Shinohara | 123/520 |

FOREIGN PATENT DOCUMENTS

| | | |
|---|---|---|
| 6108930 A | 4/1994 | Japan . |
| 6117333 A | 4/1994 | Japan . |

*Primary Examiner*—Thomas N. Moulis
*Attorney, Agent, or Firm*—Kenyon & Kenyon

[57] ABSTRACT

Three-way VSV switches a passage in communication with pressure sensor either to the atmosphere or to three-way VSV. The three-way VSV is provided in bypass passage connecting fuel tank with canister to switch the path to the fuel tank side or to the canister side with respect to tank internal-pressure control valve. As properly switching the three-way VSVs, the pressure sensor can detect both the pressure in the evaporation purge system and the atmospheric pressure. Upon diagnosis of defect a difference is calculated between the in-system pressure and the atmospheric pressure detected, which cancels out the dispersion or the like upon production of the pressure sensor, thus enabling to detect an accurate pressure change.

4 Claims, 11 Drawing Sheets

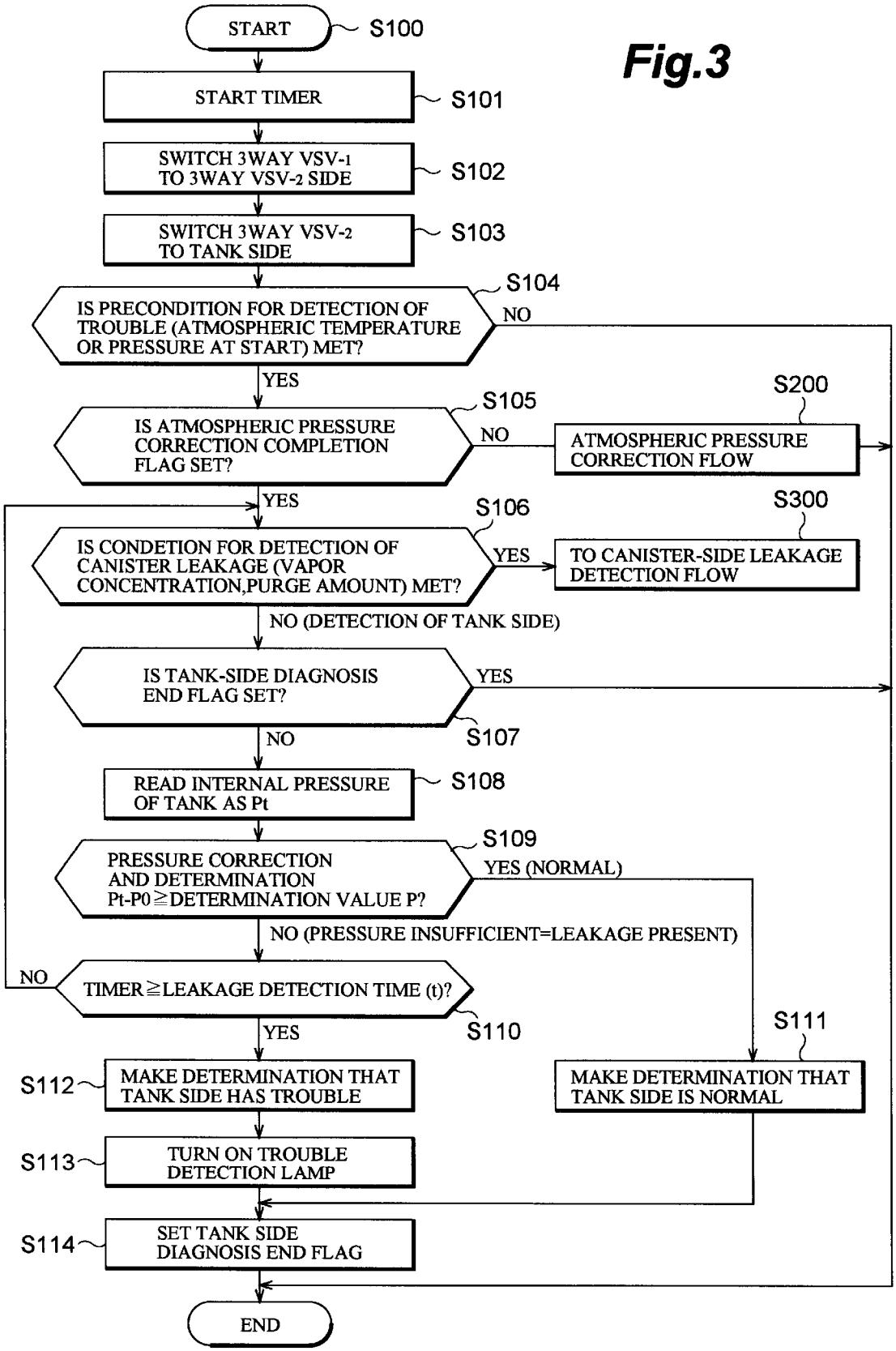
Fig.3
START
S100
START TIMER
S101
SWITCH 3WAY VSV-1 TO 3WAY VSV-2 SIDE
S102
SWITCH 3WAY VSV-2 TO TANK SIDE
S103
IS PRECONDITION FOR DETECTION OF TROUBLE (ATMOSPHERIC TEMPERATURE OR PRESSURE AT START) MET?
S104
NO
YES
IS ATMOSPHERIC PRESSURE CORRECTION COMPLETION FLAG SET?
S105
NO
S200
ATMOSPHERIC PRESSURE CORRECTION FLOW
YES
IS CONDETION FOR DETECTION OF CANISTER LEAKAGE (VAPOR CONCENTRATION,PURGE AMOUNT) MET?
S106
YES
S300
TO CANISTER-SIDE LEAKAGE DETECTION FLOW
NO (DETECTION OF TANK SIDE)
IS TANK-SIDE DIAGNOSIS END FLAG SET?
YES
S107
NO
READ INTERNAL PRESSURE OF TANK AS Pt
S108
PRESSURE CORRECTION AND DETERMINATION Pt-P0≧DETERMINATION VALUE P?
S109
YES (NORMAL)
NO (PRESSURE INSUFFICIENT=LEAKAGE PRESENT)
NO
TIMER≧LEAKAGE DETECTION TIME (t)?
S110
YES
S111
S112
MAKE DETERMINATION THAT TANK SIDE HAS TROUBLE
MAKE DETERMINATION THAT TANK SIDE IS NORMAL
S113
TURN ON TROUBLE DETECTION LAMP
S114
SET TANK SIDE DIAGNOSIS END FLAG
END

DEFECT DIAGNOSING APPARATUS OF EVAPORATION PURGE SYSTEM

BACKGROUND OF THE INVENTION

1. Field of the Invention

The present invention relates to a defect diagnosing apparatus of evaporation purge system for diagnosing a defect of an evaporation purge system of from a fuel tank through a canister to a purge passage.

2. Related Background Art

A conventional defect diagnosing apparatus of evaporation purge system is described in Japanese Laid-open Patent Application No. 6-108930.

SUMMARY OF THE INVENTION

FIG. 10 shows an example of the defect diagnosing apparatus of evaporation purge system related to the Japanese Laid-open Patent Application No. 6-108930. This apparatus is constructed so as to be capable of measuring an in-system pressure on the canister 102 side and an in-system pressure on the fuel tank 103 side with respect to internal-pressure control valve 105 separately by pressure sensor 100. For diagnosing the fuel tank 103 side, three-way valve 101 is switched to the fuel tank 103 side with on-off valve 109 being closed and pressure behavior in this system is measured by the pressure sensor 100. For diagnosing the canister 102 side, VSV (Vacuum Switching Valve) 106 for purge control is opened to introduce a negative pressure generated in suction pipe 107 during operation of engine, through purge passage 108 into the canister 102. After introduction of the negative pressure, the VSV 106 is closed and pressure behavior thereafter is measured by the pressure sensor 100.

As an approach for diagnosing presence or absence of defect in such defect diagnosing apparatus there are methods for either confining a predetermined pressure in the evaporation purge system (hereinafter referred to as "in the system") or hermetically closing the evaporation purge system, and thereafter increasing the pressure in the system by vapor generated in the fuel tank or generating a negative pressure by consumption of fuel. In such cases, as long as a hole or the like is absent in the system, the in-system pressure will undergo a transition past the atmospheric pressure to a positive pressure or to a negative pressure; if a hole or the like is present, the in-system pressure will be settled near the atmospheric pressure. Accordingly, the pressure sensor, detecting the transition of the in-system pressure using the atmospheric pressure as a reference, is a pressure difference type pressure sensor for outputting a pressure difference from the atmospheric pressure.

It is, however, the present status that this pressure sensor inevitably have a measurement error due to influence of dispersion upon production or aged deterioration. Therefore, if the difference between the in-system pressure and the atmospheric pressure was small as shown in FIG. 11, there was a possibility that the apparatus made erroneous determination that a defect was present. The ordinate axis of the graph shown in FIG. 11 represents the output from the pressure difference type pressure sensor.

The present invention has been accomplished to solve the above problem and an object of the present invention is to provide a defect diagnosing apparatus of evaporation purge system capable of performing accurate defect diagnosis even under such circumstances as to cause a measurement error due to the influence of dispersion upon production of pressure sensor or aged deterioration.

The first defect diagnosing apparatus of evaporation purge system is a defect diagnosing apparatus of evaporation purge system for diagnosing a defect of an evaporation purge system, based on a pressure change in the evaporation purge system routed from a fuel tank through a vapor passage to a canister and further from this canister to a purge passage, the defect diagnosing apparatus of evaporation vapor system comprising: a pressure sensor connected to the evaporation purge system; atmospheric pressure introducing means for introducing the atmospheric pressure to the pressure sensor; and determining means for making diagnosis of a defect of the evaporation purge system, based on a difference between the atmospheric pressure and an in-system pressure of the evaporation purge system, detected by the pressure sensor.

The above configuration permits the pressure sensor to detect the atmospheric pressure, but the atmospheric pressure detected herein is a value including the measurement error due to the influence of aged deterioration or the like, as described above. Further, this pressure sensor can also detect the pressure inside the evaporation purge system connected thereto. Accordingly, the same pressure sensor detects the atmospheric pressure as a reference and the in-system pressure of the evaporation purge system as a diagnosed object and the determining means calculates the difference between the two pressures thus detected. This cancels out the influence of aged deterioration or the like on the pressure sensor, so that an accurate pressure change can be detected using the atmospheric pressure as a reference.

The second defect diagnosing apparatus of evaporation purge system is constructed in such a manner that the atmospheric pressure introducing means of the first apparatus comprises: passage switching means for switching a passage communicating with the pressure sensor to either one of the fuel tank, the canister, and the atmosphere; and switching control means for controlling switching of the passage switching means, wherein the switching control means comprises: first means for performing switching from a state in which the pressure sensor communicates with the fuel tank to a state in which the pressure sensor communicates with the canister; and second means for performing switching to a state in which the pressure sensor communicates with the atmosphere when a pressure on the canister side, detected by the pressure sensor, is a predetermined negative pressure after switching control by the first means.

When the status before detection of the atmospheric pressure is a state in which the pressure sensor detects the pressure on the fuel tank side, the inside of the passage up to the pressure sensor is filled with the vapor generated in the fuel tank (FIG. 1A). When under such circumstances the passage switching means switches the path in communication with the pressure sensor to the atmosphere, the vapor filling the path between the passage switching means and the pressure sensor is discharged to the atmosphere upon the switching (FIG. 1B). Therefore, for detecting the atmospheric pressure, the first means first makes the passage switching means switch the passage in communication with the pressure sensor to the canister. This makes the pressure sensor detect the pressure on the canister side. If a negative pressure is introduced into the canister by purge, the negative pressure will be also introduced to the path between the pressure sensor and the passage switching means upon detection of the canister-side pressure. When the passage is switched to the atmosphere in this state, the vapor in the passage having the negative pressure is not discharged to the atmosphere having a higher pressure than it. Thus, the second means performs such control after the switching control by the first means that the second means confirms that the canister-side pressure detected is the predetermined negative pressure and thereafter makes the passage switching means switch the path in communication with the pressure sensor to the atmosphere.

In the third defect diagnosing apparatus of evaporation purge system, the atmospheric pressure introducing means of the first apparatus comprises: a purge control valve, disposed in the purge passage, for opening or closing the purge passage; and valve opening control means for opening the purge control valve after stop of an internal combustion engine.

By opening the purge control valve after stop of the internal combustion engine in this way, the atmosphere is introduced into the evaporation purge system and the pressure of the atmosphere thus introduced is detected by the pressure sensor.

In the fourth defect diagnosing apparatus of evaporation purge system, the atmospheric pressure introducing means of the first apparatus is an open valve for forcing the canister to be opened to the atmosphere when the atmospheric pressure is detected by the pressure sensor. By opening the open valve, the atmosphere is introduced through the canister into the evaporation purge system and the pressure of the atmosphere thus introduced is detected by the pressure sensor.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF THE DRAWINGS

FIG. 3 is a flowchart to show the processing operation in the defect diagnosing apparatus of FIG. 2;

DESCRIPTION OF THE PREFERRED EMBODIMENTS

Embodiments of the present invention will be described with reference to the accompanying drawings.

Figure 2:
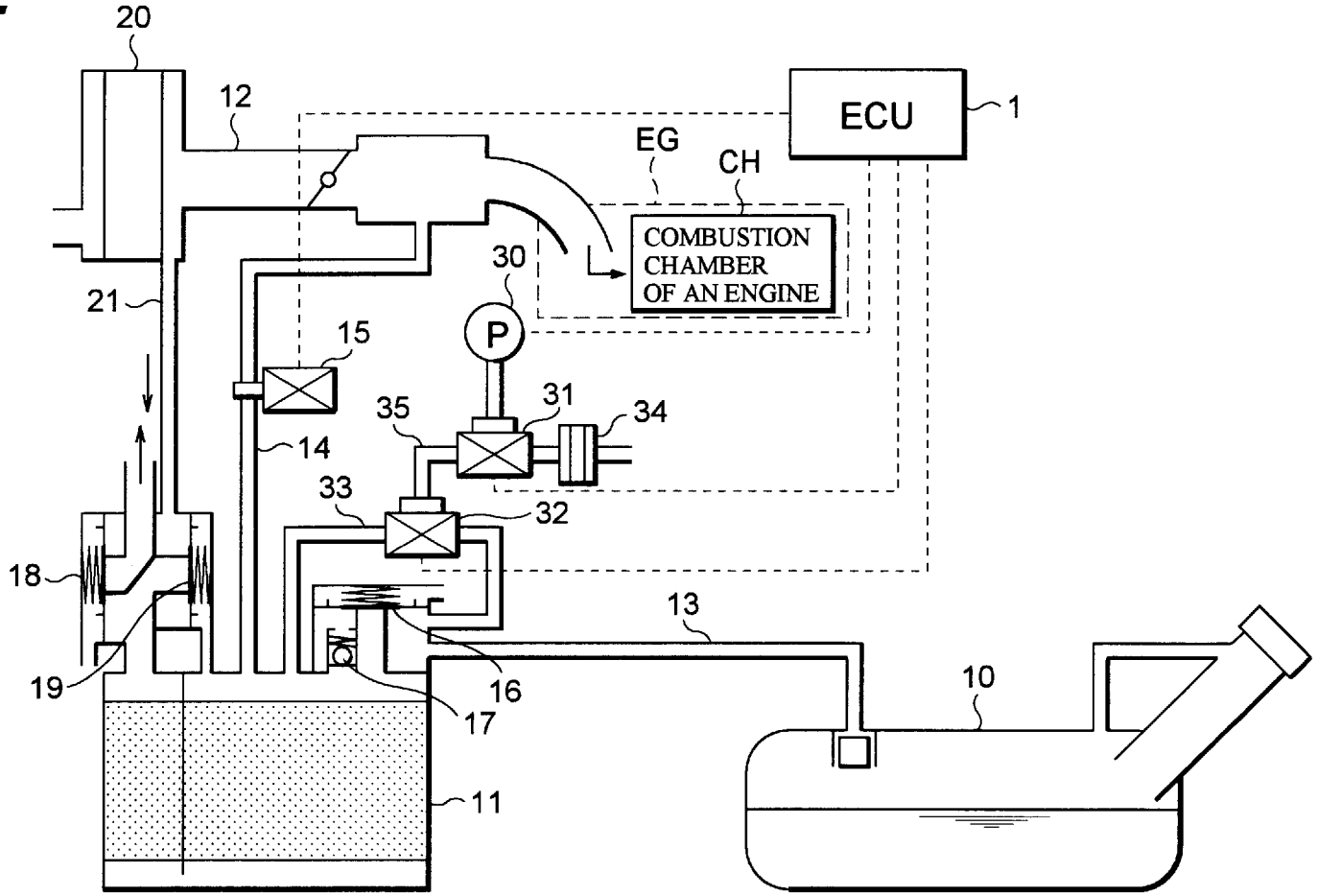
FIG. 2 is a system configuration diagram to show the defect diagnosing apparatus of evaporation purge system according to the first embodiment.

FIG. 2 shows an evaporation purge system provided with the defect diagnosing apparatus according to the first embodiment. This evaporation purge system is a system for making charcoal canister 11 (hereinafter referred to as a canister) temporarily adsorb the vapor (evaporative fuel) generated in the fuel tank 10 and for making the adsorbed vapor desorb from the canister 11 to introduce it into a suction (intake) passage 12, utilizing the negative pressure generated in the suction passage 12 during operation of engine, and the vapor thus introduced is burned in a combustion chamber of an internal combustion engine. Vapor passage 13 connects the fuel tank 10 with the canister 11 and purge passage 14 connects the canister 11 with the suction passage 12, thus composing the evaporation purge system.

Solenoid-actuated purge duty VSV (Purge Duty Vacuum Switching Valve) 15 is provided in the purge passage 14 and is arranged to open or close with reception of an electric signal from an electronic control unit 1 (hereinafter referred to as "ECU"), thus duty-controlling an amount of vapor flowing into the suction passage 12. The vapor passage 13 is provided with tank internal-pressure control valve 16 for opening or closing this vapor passage 13 by valve operation, which has a mechanism to open when the pressure in the fuel tank 10 becomes greater than a predetermined pressure because of the vapor generated in the fuel tank 10. Reference numeral 17 designates a back purge valve for making conduction of the vapor passage 13 when the pressure inside the fuel tank 10 becomes a predetermined pressure lower than that on the canister 11 side. The back purge valve 17 opens when the internal pressure of tank is reduced because of a decrease in the temperature of fuel in the fuel tank 10, so as to control the negative pressure in the fuel tank 10 above the predetermined pressure, thereby preventing breakage of the fuel tank 10.

The canister 11 is provided with an atmosphere open valve 18 for opening when the pressure in the canister 11 reaches a predetermined positive pressure, thereby opening the canister 11 to the atmosphere, and also with an atmosphere suction valve 19 for opening when the pressure in the canister 11 becomes negative because of the purge, thereby sucking the atmosphere into the canister 11. The atmosphere suction valve 19 is connected through the suction passage 21 to the downstream side of filter 20 provided in the suction passage 12, so that air from which dust is removed by the filter 20 is introduced through the atmosphere suction valve 19 into the canister 11.

For diagnosing a defect of the evaporation purge system constructed as described, bypass passage 33 for communicating the fuel tank 10 with the canister 11 is provided so as to bypass the tank internal-pressure control valve 16 and pressure sensor 30 is connected through two three-way switching, solenoid-actuated valves (hereinafter referred to as three-way VSVs) 31, 32 to the bypass passage 33. Each of the three-way VSVs 31, 32 has one common port and two switching ports and the pressure sensor 30 is connected to the common port of three-way VSV 31. One connection port of three-way VSV 31 opens to the atmosphere through filter 34 and the other connection port thereof is connected through communication passage 35 to the common port of three-way VSV 32. one connection port of the three-way VSV 32 is connected to the canister 11 side with respect to the tank internal-pressure control valve 16 and the other port thereof to the fuel tank 10 side with respect to the tank internal-pressure control valve 16. Accordingly, the pressure sensor 30 can detect either one of the in-passage pressure on the fuel tank 10 side with respect to the tank internal-pressure control valve 16, the in-passage pressure on the canister 11 side with respect thereto, and the atmospheric pressure, by switching operation of the respective three-way VSVs 31, 32.

Each of these pressure sensor 30, three-way VSVs 31, 32, and purge duty VSV 15 is connected to ECU 1, so that a pressure signal from the pressure sensor 30 is supplied to the ECU 1 and so that the on/off control of the purge duty VSV 15 and the switching control of the three-way VSVs 31, 32 all are carried out under control of ECU 1.

The operation of the evaporation purge system constructed as described above will be described schematically. When after start of the internal combustion engine the predetermined purge condition (for example, detection of completion of warm-up of engine, detection of a load on engine over a predetermined value, etc.) is met, the purge duty VSV 15 is actuated under control of ECU 1 to start the purge of vapor adsorbed in the canister 11. When the purge duty VSV 15 is opened, the negative pressure in the suction passage 12 is introduced through the purge passage 14 into the canister 11. This opens the atmosphere suction valve 19, so that the atmosphere having passed through the air filter 20 is introduced into the canister 11. The atmosphere having passed through the inside of canister 11 purges the vapor adsorbed in the canister 11 to be introduced into the suction passage 12. The internal pressure in the canister under the purge is a negative pressure because of the closed state of the atmosphere open valve 18 and is controlled at a constant pressure by the atmosphere suction valve 19. The ECU 1 controls on/off of the purge duty VSV 15 so as to reduce influence of the purge gas on the exhaust emission. By repetitively performing such sequential operation, the vapor is prevented from being discharged to the atmosphere and overflow of the canister 11 is prevented.

Now, the processing operation of the defect diagnosing apparatus of evaporation purge system as described above will be described based on the flowcharts of FIG. 3 and FIG. 4. This processing operation is, for example, a routine process carried out in the ECU 1 every predetermined time. In the flowcharts, the three-way VSV 31 will be expressed by "three-way VSV-1" and the three-way VSV 32 by "three-way VSV-2." With start of this process beginning at step 100 ("step" will be referred to as S), a timer for counting the time of diagnosis is started (S101).

Next, the three-way VSV 31 is switched to the three-way VSV 32 side (S102) and thereafter the three-way VSV 32 is switched to the fuel tank 10 side (S103). This causes the pressure on the fuel tank 10 side to be introduced to the pressure sensor 30. After this, it is determined whether the precondition for start of detection of defect of the evaporation purge system, such as the atmospheric pressure or the atmospheric temperature upon start of the internal combustion engine, is met (S104). If this precondition is not met (or if "No" at S104), this routine is ended without performing the diagnosis, because a possibility of failing to carry out accurate defect diagnosis is high. At the end the timer of S101 is reset. While the precondition for start of defect detection is not met at S104 as described, the processes of S100 to S104 are repeated, whereby the pressure sensor 30 normally monitors the pressure behavior on the fuel tank 10 side in this way.

When S104 results in determining that the precondition for start of defect detection is met (or if "Yes" at S104), the following defect diagnosis will be started. It is first determined whether an atmospheric pressure correction completion flag to indicate completion of a correction process of the atmospheric pressure is set or not (S105). Here, if the atmospheric pressure correction completion flag is not set (or if "No" at S105), an atmospheric pressure correction flow indicated by S200 and after in FIG. 4 is carried out and this routine is then ended.

Figure 4:
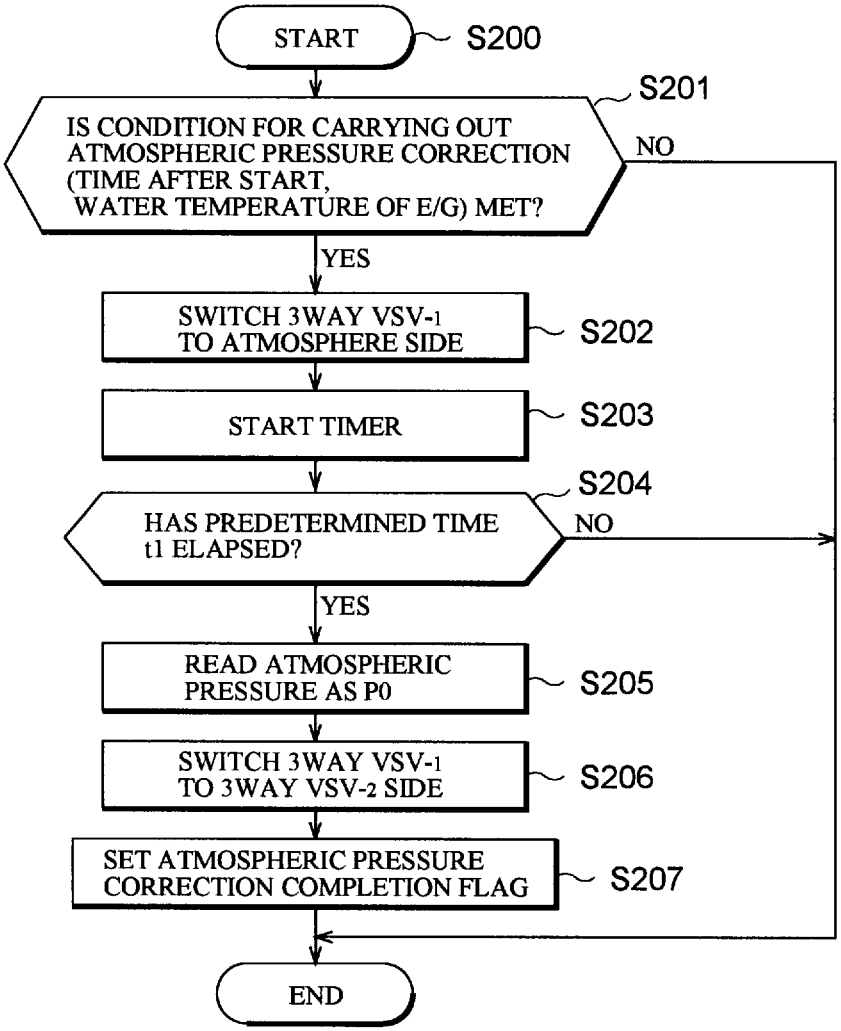
FIG. 4 is a flowchart to show an atmospheric pressure correction flow in FIG. 3.

The atmospheric pressure correction flow of FIG. 4 is described here. When this process is started at S200, it is first determined whether the condition to carry out the atmospheric pressure correction is met (S201). For example, since the accuracy of the pressure sensor is likely to be affected by the temperature of ambience, the condition to carry out the correction may be either that the time is immediately before execution of defect diagnosis, that a predetermined time has elapsed after start of the internal combustion engine, that warm-up of the internal combustion engine is completed, or the like. When the correction start condition is not met at S201, this routine is ended.

When S201 results in determining that the correction start condition of atmospheric pressure is met (or if "Yes" at S201), the three-way VSV 31 is switched to the atmosphere side (S202). This causes the atmosphere to be guided through the filter 34 to the pressure sensor 30. Since the pressure measured by the pressure sensor 30 is switched here, the timer is started (S203) and a lapse of a predetermined time is awaited before the pressure of the atmosphere introduced to the pressure sensor 30 becomes stable. Specifically, it is determined at S204 whether the predetermined time t1 has elapsed by a count value of the timer. If the predetermined time t1 does not have elapsed yet (or if "No" at S204), this routine will be ended. When S204 results in determining that the count value of timer indicates the lapse of the predetermined time t1 (or if "Yes" at S204), a detected value by the pressure sensor 30 will be read as atmospheric pressure P0 (S205). After the atmospheric pressure P0 is read, the three-way VSV 31 is switched to the three-way VSV 32 side (S206) and the atmospheric pressure correction completion flag to indicate completion of correction of the atmospheric pressure is set (S207). After completion of the sequential atmospheric pressure correction flow in this way, the process returns to the flow of FIG. 3.

In the next routine the processes of S100 to S105 are repeated and, because the atmospheric pressure correction completion flag is set in the previous routine ("Yes" at S105), the flow proceeds to S106.

It is determined at S106 whether the leakage detection condition on the canister 11 side is met. Namely, this step is for determining whether a stable negative pressure can be achieved in the canister 11. For example, if a duty value of the purge duty VSV 15 is not less than a predetermined value (%) or if a learning value of purge vapor concentration is not more than a predetermined value, it is determined that the canister hole detection condition is met. When the leakage detection condition on the canister 11 side is determined to be met (or if "Yes" at S106), the process transfers to a leakage detection flow of the canister side (S300). After end of this flow, the flow returns to S100.

When the leakage detection condition on the canister 11 side is determined not to be met (or if "No" at S106), the flow will move to leakage detection of the fuel tank 10 side of S107 and after. Since at this stage the tank-side determination is not ended yet ("No" at S107), the flow goes to S108. Since the flow has already passed through S101 and S102, the in-passage pressure on the fuel tank 10 side is guided to the pressure sensor 30 and a detected value by the pressure sensor 30 at this time is read as Pt at S108.

Determination of presence or absence of leakage on the fuel tank 10 side is made based on that absence of a hole or the like in the system on the fuel tank 10 side must result in increasing the in-system pressure over the atmospheric pressure because of influence of the vapor generated in the fuel tank 10, whereas presence of a hole or the like must result in detecting the in-system pressure stabilized near the atmospheric pressure. At S109, "determination value P," which is a pressure a predetermined value higher than the atmospheric pressure, is preliminarily determined as a pressure to be a reference for determination of presence or absence of leakage, and when the in-system pressure on the fuel tank 10 side detected by the pressure sensor 30 is increased to the determination value P or more, it is determined that a hole or the like is absent in the system on the fuel tank 10 side. For this determination, the value of atmospheric pressure P0 read before in the flow of S200 and after is used for correction. Specifically, the atmospheric pressure P0 is subtracted from the detection value Pt of pressure sensor 30 read at S108. Then this value is compared with the determination value P. This correction for the detected value Pt can cancel out the influence of aged deterioration of the pressure sensor 30, dispersion upon production thereof, and the like and thus enables to capture an accurate pressure change using the atmospheric pressure as a reference, thereby permitting more accurate defect diagnosis.

Since the vapor generated causes the in-system pressure on the fuel tank 10 side to increase gradually, the value of Pt−P0 is normally smaller than the determination value P at the first determination ("No" at S109) and the flow proceeds to next S110. At S110 the time for continuing the leakage detection is preliminarily defined as "leakage detection time (t)." If the count value of the timer started at S101 is smaller than the leakage detection time (t) (or if "No" at S110), the processes of S106 and after will be repeated. Therefore, the processes of S106 to S110 are repeated before the count value of the timer reaches the leakage detection time (t). If during that period the in-system pressure on the fuel tank side increases to the determination value P or more (or if "Yes" at S109), it will be determined that any defect like a hole is absent in the system on the fuel tank 10 side (S111).

On the other hand, if the in-system pressure on the fuel tank 10 side does not increase up to the determination value P after the count value of timer started at S101 reaches the leakage detection time (t) (or if "Yes" at S110), it will be determined that a defect such as a hole is present in the system on the fuel tank 10 side (S112), and a defect detection lamp will be turned on (S113), thereby giving an alarm to let a driver know the fact.

After end of the determination process by S111 or S113, a flag to indicate the end of the defect determination on the fuel tank 10 side is set (S114) and this routine is ended.

Although the detailed description was omitted, the process transfers to the canister-side leakage detection flow (S300) when S106 results in determining that the leakage detection condition on the canister 11 side is met (or if "Yes" at S106), and also in this detection flow, the defect determination is carried out similarly, using the value of atmospheric pressure P0 read in the atmospheric pressure correction flow (S200 and after) for correction of detected pressure value.

Figure 1B:
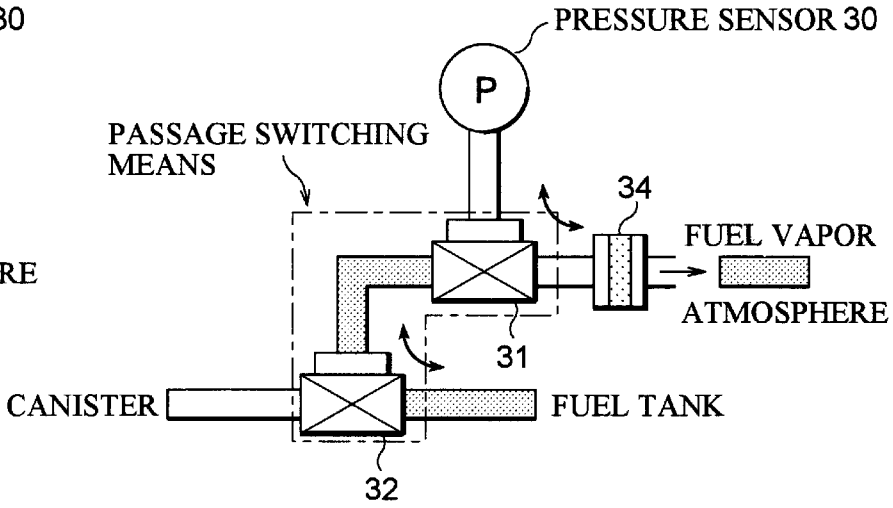
FIGS. 1A and 1B are explanatory drawings to show the states where the vapor filling the inside of the evaporation purge system is discharged to the atmosphere upon the switching operation of switching valve.
Figure 1A:
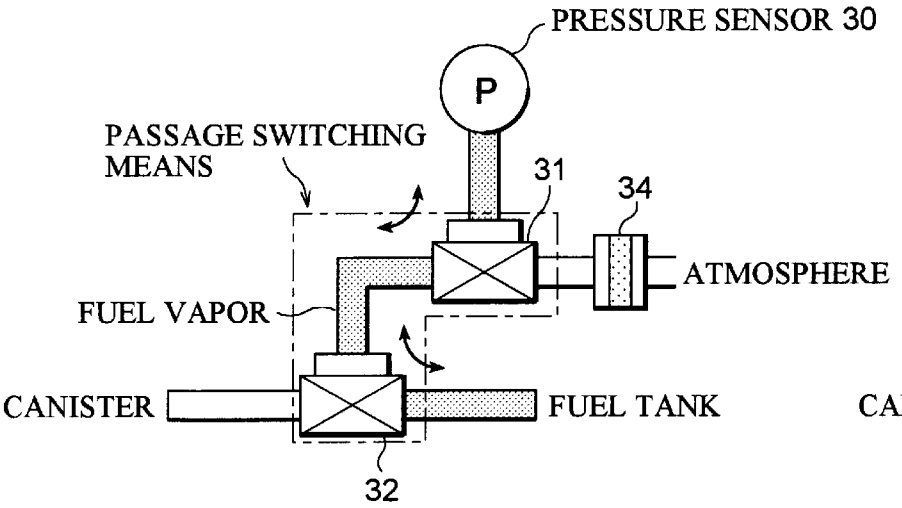

Another embodiment of the atmospheric pressure correction flow will be described. In the previous embodiment, when the three-way VSV 31 is switched to the atmosphere side in order to detect the atmospheric pressure during execution of the atmospheric pressure correction flow of S200 and after, the vapor might be discharged to the atmosphere. More specifically, supposing the circumstances before the switching of the three-way VSV 31 to the atmosphere side are such that the pressure sensor 30 is detecting the pressure on the fuel tank 10 side, the vapor generated in the fuel tank 10 fills the inside of the passage up to the pressure sensor 30 (see FIG. 1A). When the three-way VSV 31 is switched to the atmosphere side under such circumstances, the communication passage 35 between the pressure sensor 30 and the three-way VSV 31 comes to communicate with the atmosphere side upon that switching, so that the vapor filling the inside of the communication passage 35 will be discharged to the atmosphere (see FIG. 1B).

Figure 5:
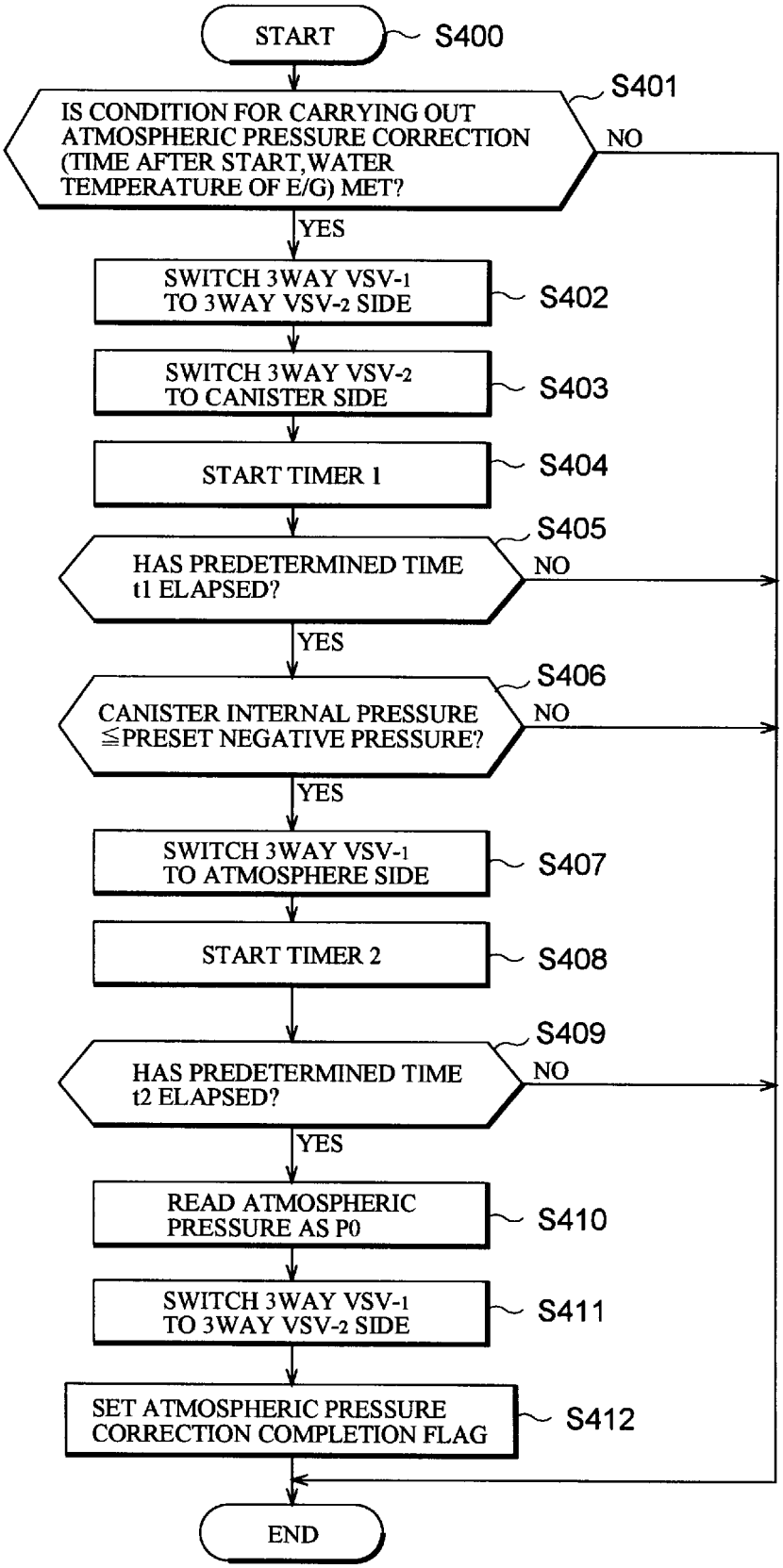
FIG. 5 is a flowchart to illustrate another embodiment of the atmospheric pressure correction flow.

Thus, a flow solving this problem is shown in FIG. 5. With start of this process at S400, it is first determined whether the condition to carry out the atmospheric pressure correction is met (S401). This correction start condition of atmospheric pressure is the same as the condition at S201 described above. If this condition is not met, this routine will be ended.

If the correction start condition of atmospheric pressure is met (or if "Yes" at S401), the three-way VSV 31 is switched to the three-way VSV 32 side (S402) and the three-way VSV 32 is switched to the canister 11 side (S403). This causes the in-passage pressure on the canister 11 side to be guided to the pressure sensor 30. After the switching, the timer 1 is started in order to secure the time for stabilizing the introduced pressure (S404). It is then determined whether the count value of timer 1 reaches the predetermined time t1 (S405). If the count value of timer 1 does not reach the predetermined time t1 (or if "No" at S405), this routine will be ended. When S405 results in determining that the count value of timer 1 reaches the predetermined time t1 (or if "Yes" at S405), it will be then determined whether the pressure on the canister 11 side detected by the pressure sensor 30 is not more than a predetermined negative pressure preliminarily determined (S406). This is determination to check whether a sufficient negative pressure is introduced into the system on the canister 11 side by the purge. If it is determined that the pressure on the canister 11 side is more than the predetermined negative pressure (or if "No" at S406), this routine will be ended. On the other hand, when it is determined that the pressure on the canister 11 side is not more than the predetermined negative pressure (or if "Yes" at S406), then the three-way VSV 31 will be switched to the atmosphere side (S407). By switching the three-way VSV 31 to the atmosphere side with the inside of the system being under the negative pressure in this way, the atmosphere can be introduced to the pressure sensor 30 without discharging the vapor to the atmosphere, even in the case wherein the communication passage 35 is in communication with the atmosphere.

After the switching of the three-way VSV 31 to the atmosphere side, count by timer 2 is started in order to secure the time for stabilizing the atmospheric pressure thus introduced (S408). It is then determined whether the count value of timer 2 reaches the predetermined time t2 (S409). If the count value of timer 2 does not reach the predetermined time t2 (or if "No" at S409), this routine will be ended. When S409 results in determining that the count value of timer 2 reaches the predetermined time t2 (or if "Yes" at S409), then the detected value by the pressure sensor 30 will be read as the atmospheric pressure P0 (S410). After this, the three-way VSV 31 is switched to the three-way VSV 32 side to connect the pressure sensor 30 to the evaporation purge system again (S411). Then the atmospheric pressure correction completion flag is set (S412) and this flow is ended. The above switching of the three-way VSVs 31, 32 can prevent the vapor from being discharged to the atmosphere upon switching. After completion of this flow via S412, the process returns to S200 of the flowchart of FIG. 3 to carry out the defect diagnosis process based on the atmospheric pressure P0 obtained herein.

Figure 6:
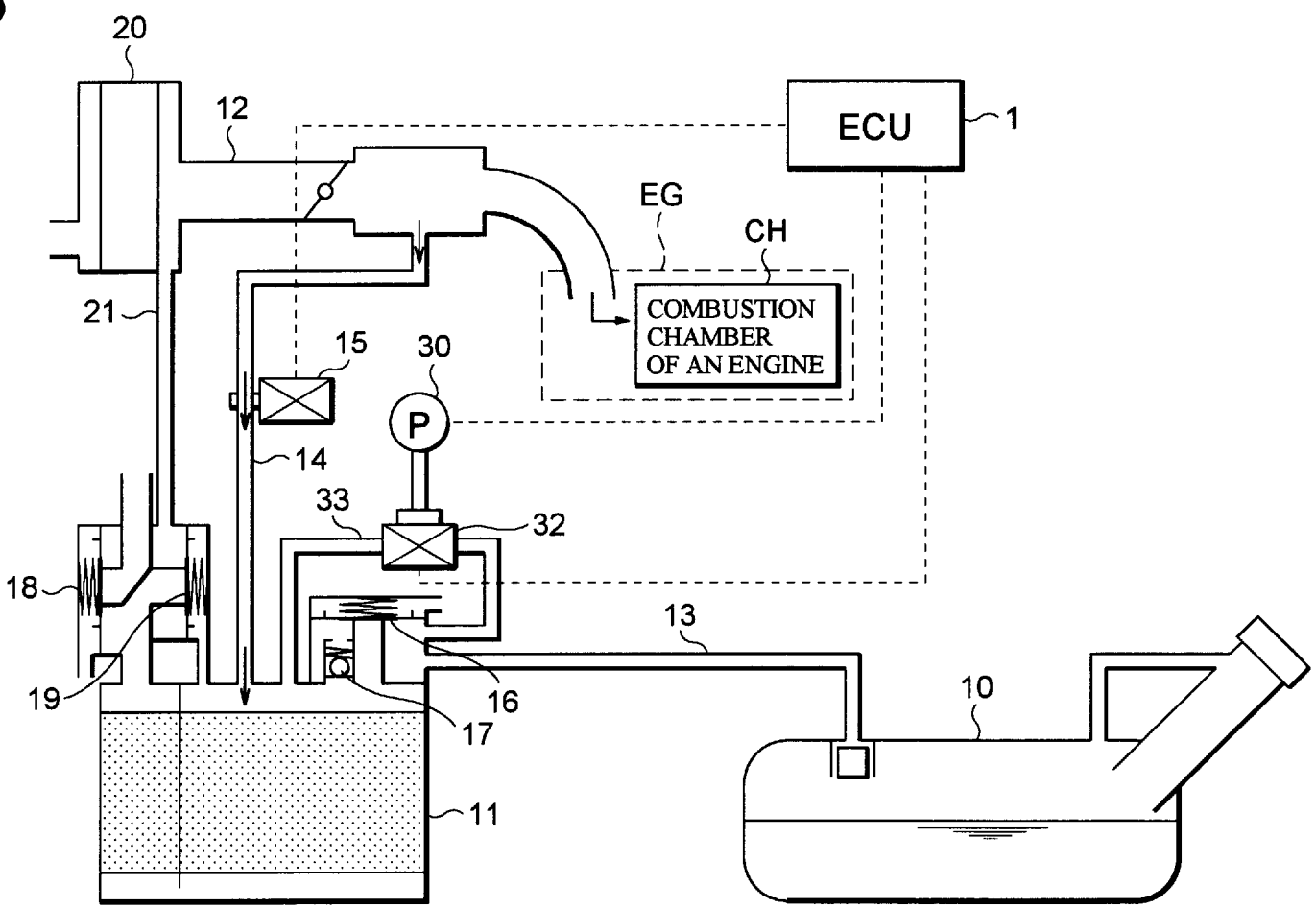
FIG. 6 is a system configuration diagram to show the defect diagnosing apparatus of evaporation purge system according to the second embodiment.

Here, an evaporation purge system provided with a defect diagnosing apparatus according to the second embodiment is further shown in FIG. 6. In this embodiment, the pressure sensor 30 is connected to the common port of the three-way VSV 32 provided in the bypass passage 33 and the correction of the atmospheric pressure is carried out utilizing the purge duty VSV 15. The other configuration is substantially the same as in FIG. 2 and the same components as those in FIG. 2 are denoted by the same reference symbols.

Figure 7:
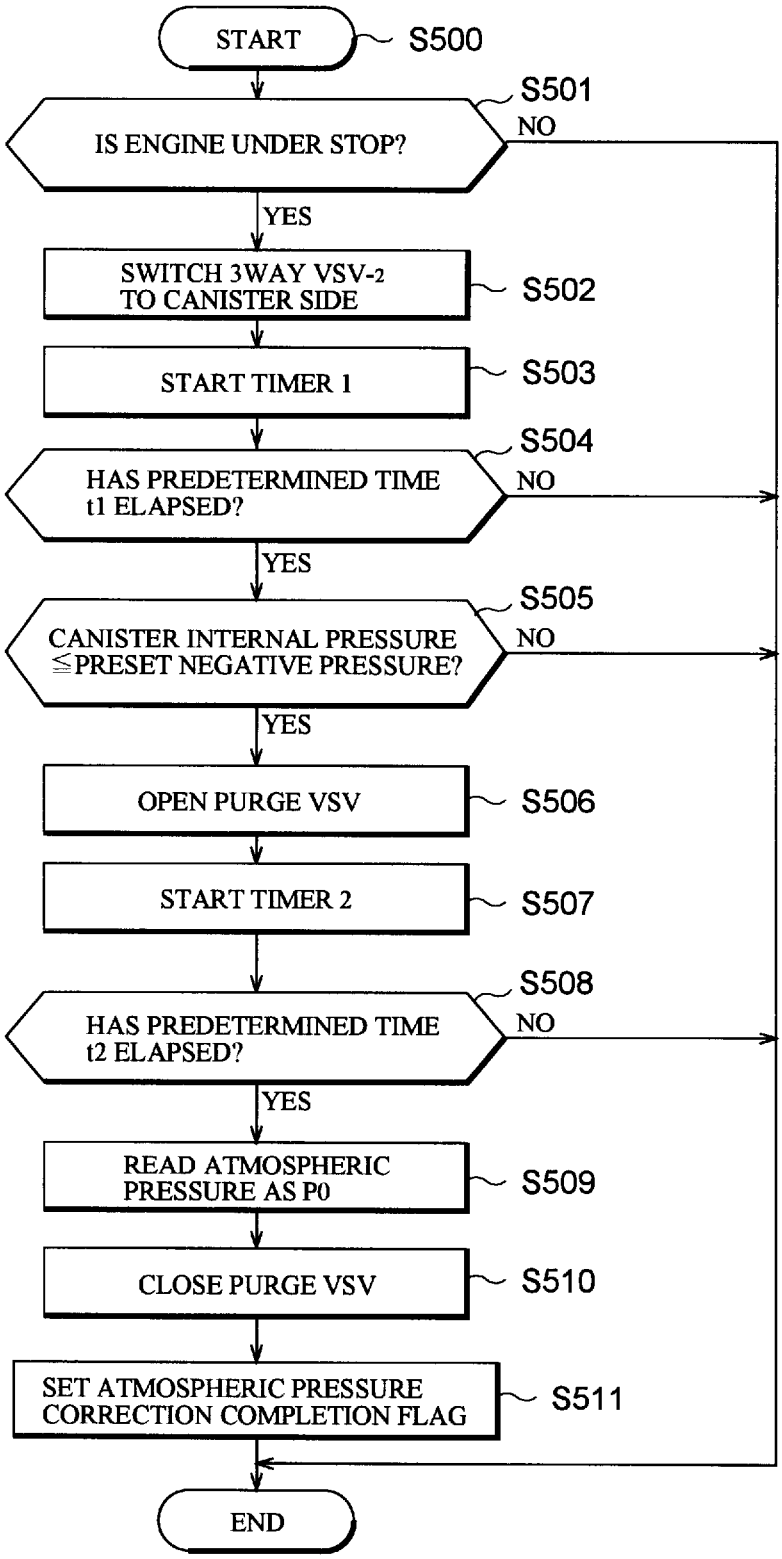
FIG. 7 is a flowchart to show the atmospheric pressure correction flow in the defect diagnosing apparatus of FIG. 6.

The atmospheric pressure correction flow for the above configuration is shown in FIG. 7. With start of this process beginning at S500, it is first determined whether the internal combustion engine is under stop (S501). If the internal combustion engine is under run (or if "No" at S501), this routine will be ended. Namely, this atmospheric pressure correction process is carried out with the internal combustion engine being under stop.

When S501 results in determining that the internal combustion engine is under stop (or if "Yes" at S501), the three-way VSV 32 is switched to the canister 11 side (S502). Here, the timer 1 is started (S503) to wait for the predetermined time before the pressure on the canister 11 side introduced to the pressure sensor 30 becomes stable. Specifically, it is determined at S504 whether the count value of timer 1 reaches the predetermined time t1. If the count value does not reach the predetermined time t1 yet (or if "No" at S504), this routine will be ended. When S504 results in determining that the count value of timer 1 reaches the predetermined time t1 (or if "Yes" at S504), it is next determined whether the pressure on the canister 11 side detected by the pressure sensor 30 is not more than the predetermined negative pressure (S505). This is determination to check whether the sufficient negative pressure is introduced into the system on the canister 11 side. If it is determined that the pressure on the canister 11 side is over the predetermined negative pressure (or if "No" at S505), this routine will be ended. On the other hand, when it is determined that the pressure on the canister 11 side is not more than the predetermined negative pressure (or if "Yes" at S505), then the purge duty VSV 15 will be opened (S506). By opening the purge duty VSV 15 with the inside of the system on the canister 11 side being under the negative pressure in this way, the atmosphere can be introduced into the system without discharging the vapor adsorbed in the canister 11 to the atmosphere.

After the purge duty VSV 15 is opened, the count by timer 2 is started in order to secure the time for stabilizing the atmospheric pressure introduced into the system (S507). Then it is determined whether the count value of timer 2 reaches the predetermined time t2 (S508). If the count value of timer 2 does not reach the predetermined time t2 (or if "No" at S508), this routine will be ended. When S508 results in determining that the count value of timer 2 reaches the predetermined time t2 (or if "Yes" at S508), then the detected value by the pressure sensor 30 is read as the atmospheric pressure P0 (S509). After this, the purge duty VSV 15 is closed (S510), thereafter the atmospheric pressure correction completion flag is set (S511), and then this flow is ended.

This operation permits the pressure sensor 30 to measure the atmospheric pressure, utilizing the purge duty VSV 15. Then the defect diagnosis process is carried out along the flow shown in FIG. 3, based on the atmospheric pressure P0 obtained in S500 to S511. Since the atmospheric pressure P0 is detected under stop of the internal combustion engine, S200 in the flow of FIG. 3 becomes unnecessary.

Figure 8:
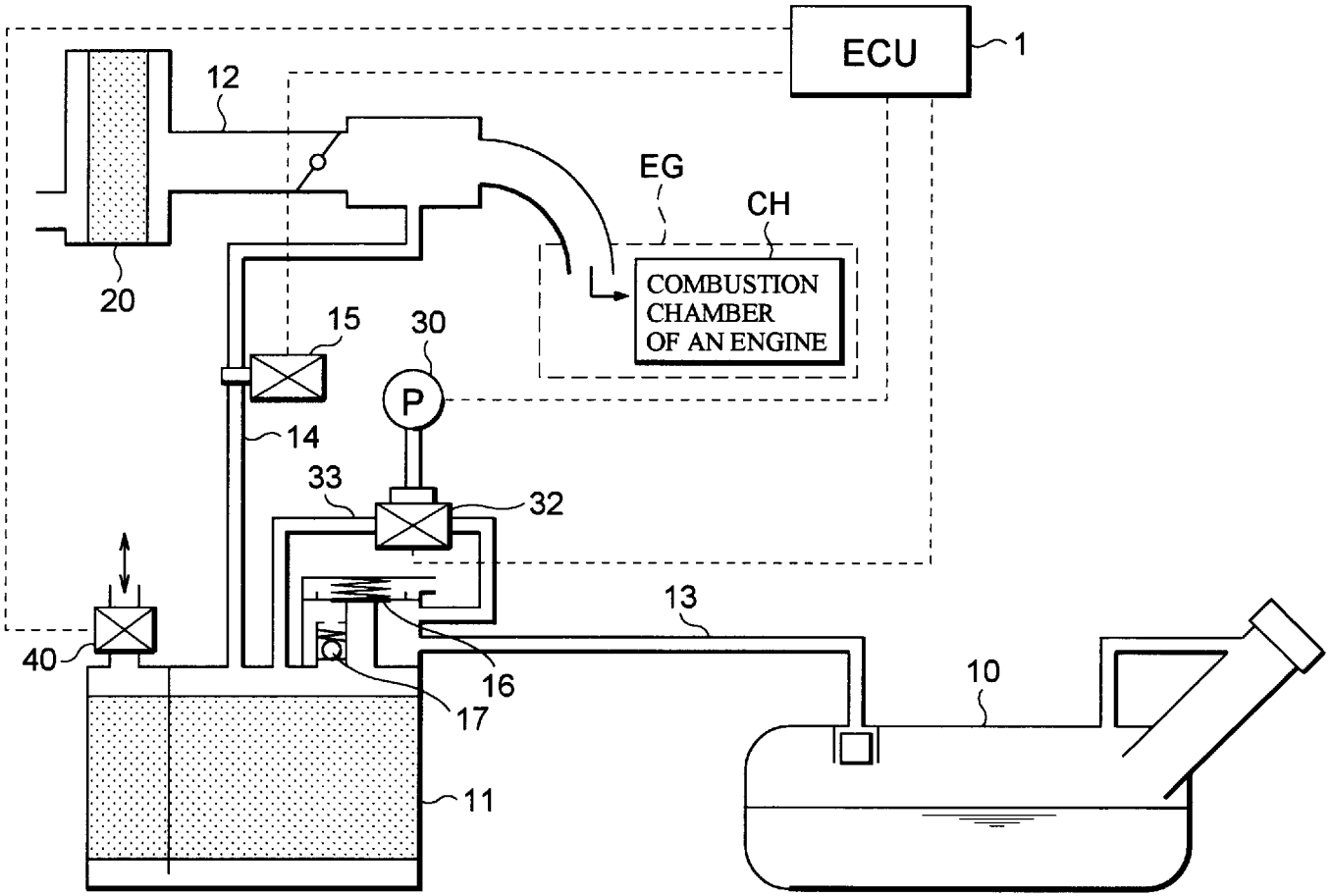
FIG. 8 is a system configuration diagram to show the defect diagnosing apparatus of evaporation purge system according to the third embodiment.

An evaporation purge system provided with a defect diagnosing apparatus according to the third embodiment is further shown in FIG. 8. This embodiment employs a canister close valve 40 mounted to the canister 11 and is arranged to introduce the atmosphere into the evaporation purge system by opening the canister close valve 40 in the atmospheric pressure correction process. The same components as those in FIG. 6 are denoted by the same reference numerals.

Figure 9:
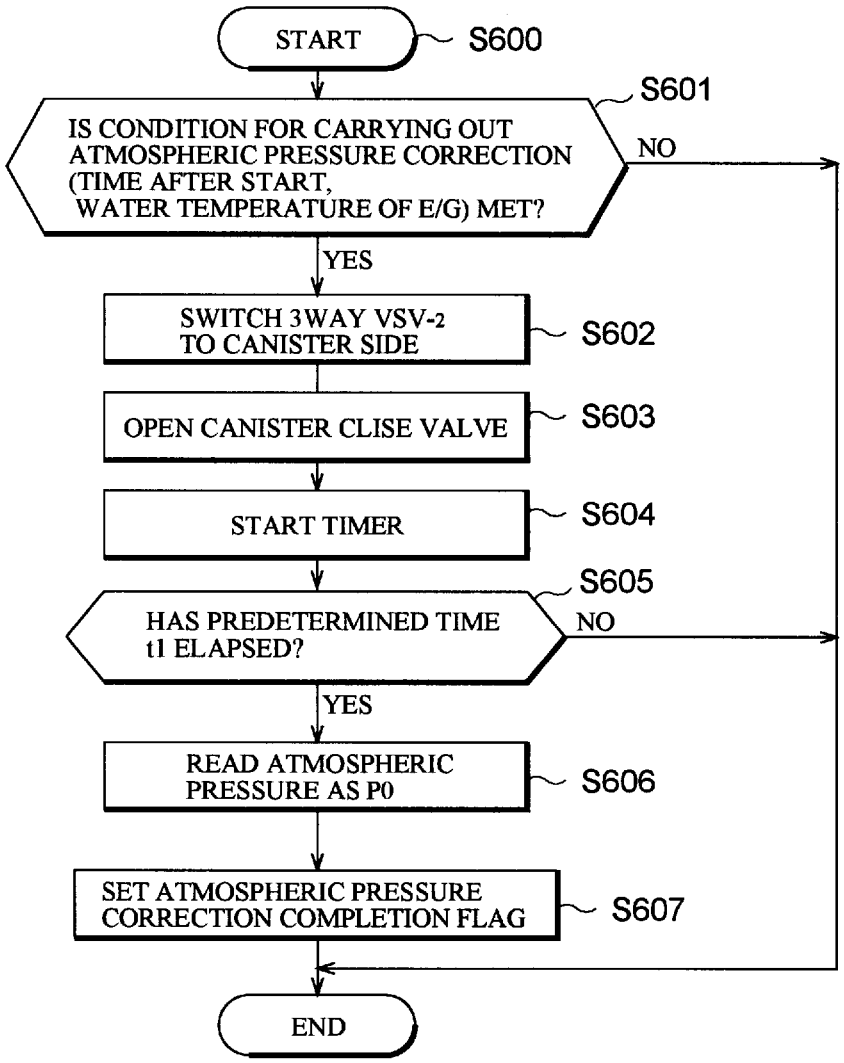
FIG. 9 is a flowchart to show the atmospheric pressure correction flow in the defect diagnosing apparatus of FIG. 8.
Figure 10:
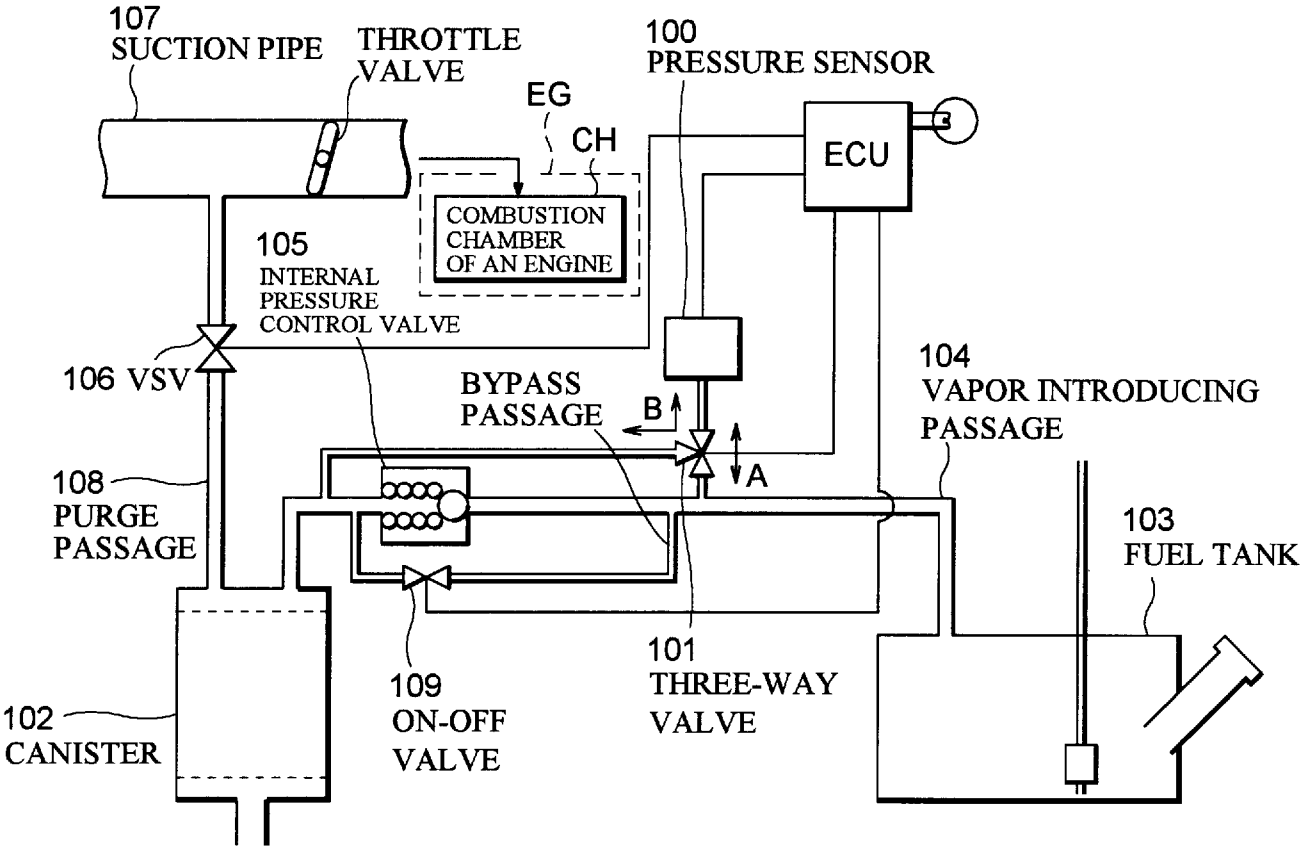
FIG. 10 is a configuration diagram to show the conventional defect diagnosing apparatus.
Figure 11:
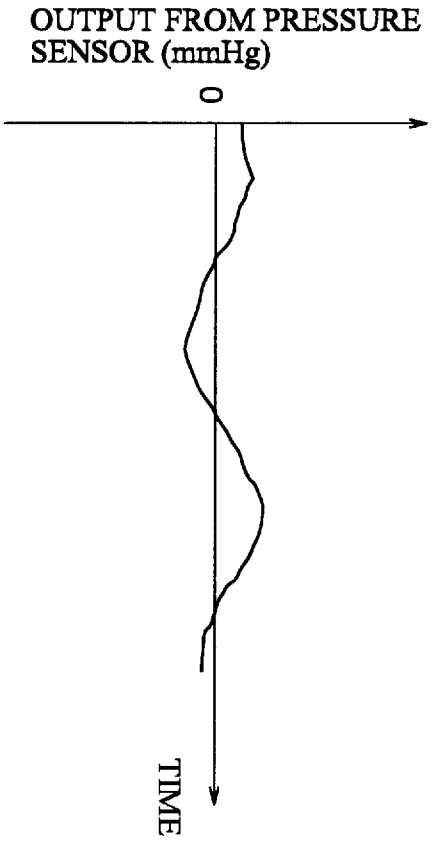
FIG. 11 is a graph to show an example of detection results by the pressure sensor.

The atmospheric pressure correction flow for this configuration is shown in FIG. 9. This flow is a flow replacing the atmospheric pressure correction flow (S200) in the flowcharts of FIG. 3 and FIG. 4 and is carried out when S105 results in determining that the atmospheric pressure correction completion flag is not set.

With start of this process beginning at S600, it is first determined whether the condition to carry out the atmospheric pressure correction is met (S601). The correction start condition of atmospheric pressure is the same as the condition at S201 described above. If this condition is not met, this routine will be ended.

If the correction start condition of atmospheric pressure is met (or if "Yes" at S601), the three-way VSV 32 will be switched to the canister 11 side (S602) and then the canister close valve 40 will be opened (S603). This forces the canister 11 to open to the atmosphere, thereby introducing the atmospheric pressure into the evaporation purge system.

After the canister close valve 40 is opened, the count by timer is started in order to secure the time for stabilizing the introduced atmospheric pressure (S604) and it is then determined whether the count value of timer reaches the predetermined time t1 (S605). If the count value of timer does not reach the predetermined time t1 (or if "No" at S605), this routine will be ended. When S605 results in determining that the count value of timer reaches the predetermined time t1 (or if "Yes" at S605), the detected value by the pressure sensor 30 will be read as the atmospheric pressure P0 (S606). After the atmospheric pressure P0 is read, the atmospheric pressure correction completion flag is set (S607) and this flow is ended.

After this flow is ended via S607, the process returns to S200 in the flowchart of FIG. 3 to carry out the defect diagnosis process of either the fuel tank 10 side or the canister 11 side, based on the atmospheric pressure P0 obtained herein.

The pressure sensor 30 exemplified in each embodiment as described above may be a pressure difference type pressure sensor for outputting a pressure difference from the atmospheric pressure or an absolute value sensor for detecting an absolute pressure. The atmospheric pressure correction flows shown in FIG. 4, FIG. 5, and FIG. 9 are examples correction flow to be carried out every time of start of the flow of FIG. 3, but, without always having to be limited to these examples, they may be carried out only at predetermined timing.

As described above, the defect diagnosing apparatus of evaporation purge system according to each claim is arranged so that the same pressure sensor detects both the atmospheric pressure introduced by the atmospheric pressure introducing means and the pressure inside the evaporation purge system to be a diagnosed object. Therefore, the step of taking the difference between the two detected pressures in the determining means can cancel out the influence of the dispersion upon production of the pressure sensor, the aged deterioration, and the like, whereby an accurate pressure change can be detected based on the reference of the atmospheric pressure, thus realizing more accurate defect diagnosis.

Particularly, the defect diagnosing apparatus of evaporation purge system according to the second apparatus is arranged to carry out the switching control of the passage switching means so that on the occasion of switching the passage in communication with the pressure sensor from the fuel tank side to the canister side, switching is made to the atmosphere side after it is confirmed that the canister side is under the predetermined negative pressure, whereby the vapor can be prevented from being discharged to the atmosphere upon the switching of the passage in communication with the pressure sensor.

As stated above, the defect diagnosing apparatus for diagnosing a defect of an evaporation purge system based on a pressure change in the evaporation purge system, the evaporation purge system having: a fuel tank (10); a canister (11); a vapor passage (13) connecting the fuel tank (10) and the canister (11); and a purge passage (14) connecting to the canister (11) to a suction passage (12) connected to a combustion chamber (CH) of the engine (EG), the apparatus comprises: a pressure sensor (30) connected to the evaporation purge system; and a control unit (1) for diagnosing defect of the evaporation purge system, based on a difference between atmospheric pressure and in-system pressure of the evaporation purge system, both of atmospheric pressure and in-system pressure being detected by the pressure sensor (30).

The defect diagnosing apparatus comprises passage switching means (31, 32, 35) for switching between a plurality of passages communicating the pressure sensor (30) to either one of the fuel tank (10), the canister (11), and the atmosphere.

The control unit (1) controls the passage switching means (31, 32, 35) so as to cause the passage switching means (31, 32, 35) to switch from the passage that communicates the pressure sensor (30) to the fuel tank (10) to a passage that communicates the pressure sensor (30) to the canister and, if the pressure in the canister (11) detected by the pressure sensor (30) is less than atmospheric pressure by a predetermined amount, the control unit (1) further causes the passage switching means (31, 32, 35) to switch the passage that communicated the pressure sensor (30) from the passage communicating with the canister (11) to the passage communicating with the atmosphere.

The defect diagnosing apparatus comprises a purge control valve (15), disposed in the purge passage (14), for opening or closing the purge passage (14).

The control unit (1) further controls the purge control valve (15) so as to cause the purge control valve (15) to open and to cause the pressure sensor (30) to be communicated via the suction passage (12) to the external atmosphere when the engine (EG) has stopped.

The defect diagnosing apparatus comprises a valve (18), the valve forcing the canister (11) to be opened to the atmosphere when the pressure sensor (30) is connected to the atmosphere.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A defect diagnosing apparatus for diagnosing a defect of an evaporation purge system based on a pressure change in the evaporation purge system, said evaporation purge system having: a fuel tank; a canister; a vapor passage connecting said fuel tank and said canister; and a purge passage connecting said canister to a suction passage connected to a combustion chamber of an engine, said apparatus comprising:

a pressure sensor connected to said evaporation purge system;

a control unit for diagnosing defect of said evaporation purge system, based on a difference between atmospheric pressure and in-system pressure of said evaporation purge system, both of atmospheric pressure and in-system pressure being detected by said pressure sensor; and a passage switching means for switching between a plurality of passages communicating said pressure sensor to either one of said fuel tank, said canister, and the atmosphere.

2. A defect diagnosing apparatus according to claim 1, wherein said control unit controls said passage switching means so as to cause said passage switching means to switch from the passage that communicates said pressure sensor to said fuel tank to a passage that communicates said pressure sensor to said canister and, if the pressure in said canister detected by said pressure sensor is less than atmospheric pressure by a predetermined amount, said control unit further causes said passage switching means to switch the passage that communicated said pressure sensor from the passage communicating with said canister to the passage communicating with the atmosphere.

3. A defect diagnosing apparatus for diagnosing a defect of an evaporation purge system based on a pressure change in the evaporation purge system, said evaporation purge system having: a fuel tank; a canister; a vapor passage connecting said fuel tank and said canister; and a purge passage connecting said canister to a suction passage connected to a combustion chamber of an engine, said apparatus comprising:

a pressure sensor connected to said evaporation purge system;

a control unit for diagnosing defect of said evaporation purge system, based on a difference between atmospheric pressure and in-system pressure of said evaporation purge system, both of atmospheric pressure and in-system pressure being detected by said pressure sensor; and a purge control valve, disposed in said purge passage for opening or closing said purge passage, wherein said control unit further controls said purge control valve so as to cause said purge control valve to open and to cause said pressure sensor to be communicated via said suction passage to the external atmosphere when said engine has stopped.

4. A defect diagnosing apparatus for diagnosing a defect of an evaporation purge system based on a pressure change in the evaporation purge system, said evaporation purge system having: a fuel tank; a canister; a vapor passage connecting said fuel tank and said canister; and a purge passage connecting said canister to a suction passage connected to a combustion chamber of an engine, said apparatus comprising:

a pressure sensor connected to said evaporation purge system;

a control unit for diagnosing defect of said evaporation purge system, based on a difference between atmospheric pressure and in-system pressure of said evaporation purge system, both of atmospheric pressure and in-system pressure being detected by said pressure sensor; and a valve, said valve forcing said canister to be opened to the atmosphere when said pressure sensor is connected to the atmosphere.

* * * * *

UNITED STATES PATENT AND TRADEMARK OFFICE

CERTIFICATE OF CORRECTION

PATENT NO. : 5,845,625

DATED : December 8, 1998

INVENTOR(S) : Toru KIDOKORO, et al

It is certified that error appears in the above-identified patent and that said Letters Patent is hereby corrected as shown below:

| Column | Line | |
|---|---|---|
| 1 | 8 | Delete "from". |
| 1 | 53 | Change "have" to --has--. |
| 1 | 54 | Change "aged" to --age--. |
| 1 | 67 | Change "aged" to --age--. |
| 2 | 18 | Change "aged" to --age--. |
| 2 | 26 | Change "aged" to --age--. |
| 5 | 1 | Change "one" to --One--. |
| 5 | 12 | Change "sensor 30" to --sensors 30--. |
| 6 | 34 | Change "does not have" to --has not--. |

UNITED STATES PATENT AND TRADEMARK OFFICE

CERTIFICATE OF CORRECTION

PATENT NO. : 5,845,625

DATED : December 8, 1998

INVENTOR(S) : Toru KIDOKORO, et al

It is certified that error appears in the above-identified patent and that said Letters Patent is hereby corrected as shown below:

| Column | Line | |
|---|---|---|
| 7 | 26 | Change "aged" to --age--. |
| 7 | 37 | Change "to next" to --next to--. |
| 10 | 61 | After "examples" insert --of--. |
| 11 | 8 | Change "aged" to --age--. |

Signed and Sealed this

Eighteenth Day of July, 2000

*Attest:*

*Attesting Officer*

Q. TODD DICKINSON

*Director of Patents and Trademarks*